US006478685B1

(12) United States Patent
Ochi

(10) Patent No.: US 6,478,685 B1
(45) Date of Patent: Nov. 12, 2002

(54) AMUSEMENT SYSTEM

(75) Inventor: Yasushi Ochi, Osaka (JP)

(73) Assignee: Oriental Sangyo, Ltd., Osaka (JP)

( * ) Notice: Subject to any disclaimer, the term of this patent is extended or adjusted under 35 U.S.C. 154(b) by 0 days.

(21) Appl. No.: 09/417,707

(22) Filed: Oct. 13, 1999

(30) Foreign Application Priority Data

Oct. 16, 1998 (JP) ..... 10-294903

(51) Int. Cl.[7] ..... A63G 31/00

(52) U.S. Cl. ..... 472/136; 472/134; 472/135; 5/674; 5/676

(58) Field of Search ..... 472/134, 135, 472/92, 93, 94, 126; 482/35, 36; 5/450, 451, 665, 676, 674

(56) References Cited

U.S. PATENT DOCUMENTS 469,131 A * 2/1892 Freid ..... 5/665
4,788,730 A * 12/1988 Bexton ..... 5/454
5,590,430 A * 1/1997 Sereboff ..... 5/655.5
5,636,395 A * 6/1997 Serda ..... 5/691

FOREIGN PATENT DOCUMENTS

JP 3036398 1/1997

* cited by examiner

*Primary Examiner*—Kien T. Nguyen
(74) *Attorney, Agent, or Firm*—Armstrong, Westerman & Hattori, LLP

(57) ABSTRACT

An amusement system is provided which gives children an opportunity to acquire a formative artistic sense in a simple and clean manner without soiling their bodies and clothes. The amusement system includes: a playing space (A) defined by a floor (10) and partition plates (20) projecting upright on the floor (10); a plastic member (30*a*) provided over the floor (10) in the playing space (A); and a plurality of plastic members (30*b*) stacked one on another in tiers along interior surfaces of the partition plates (20) to a height that players can reach. The plastic members (30*a*, 30*b*) are each obtained by filling a gel material as a plastic material (32) into a container bag (31) of a flexible urethane sheet to about one half the volume of the container bag (31), then removing residual air from the container bag (31) by suction and sealing the container bag (31). Slack urethane sheet portions of the container bag (31) are brought into intimate contact with each other by the removal of the air, so that the plastic members (30*a*, 30*b*) each have a multiplicity of creases on a surface thereof.

10 Claims, 4 Drawing Sheets

AMUSEMENT SYSTEM

BACKGROUND OF THE INVENTION

1. Field of the Invention

The present invention relates to an amusement system which is mainly intended for infants and to be installed in an amusement section in an amusement park, a department store or a supermarket.

2. Description of Related Art

Children, particularly infants, are interested in various things present around them. For example, they find amusement in flexibly forming a plastic material such as clay into various shapes and in playing with sand to form the sand into various shapes in a sandbox in a park. Through such activities, they acquire a formative artistic sense.

However, the sandbox is currently the only amusement place that gives the children an opportunity to acquire the formative artistic sense while playing. When infants play with clay or play with sand in the sandbox, they may put pieces of the clay or sand into their mouths, and their bodies, clothes and surroundings may be soiled with the clay or sand. Particularly, the sandbox which is generally provided outdoors is often a place of evacuation for stray dogs and cats, thereby presenting health and hygienic problems.

It is therefore an object of the present invention to provide an amusement system which gives children an opportunity to acquire the formative artistic sense in a simple and clean manner without soiling their bodies and clothes.

SUMMARY OF THE INVENTION

To achieve the aforesaid object, the present invention provides an amusement system which comprises: a partitioning member defining therein a playing space; and a plastic member provided in association with the partitioning member in the playing space so that a player can touch the plastic member; the plastic member comprising a container bag formed of a flexible sheet, and a filler material such as a plastic material or a particulate material filled in the container bag in a substantially air-free state. The container bag may entirely be formed of the flexible sheet, or a portion of the container bag that cannot directly be touched by the player may be formed of a rigid material. The substantially air-free state is such that the filler material filled in the container bag can easily be displaced in the container bag by an external force and the plastic member can easily be deformed by the external force.

In the amusement system having the aforesaid construction, the player can freely depress the plastic member or gather the filler material around a portion of the plastic member into a heap. Thus, the player can get a feeling equivalent to playing with clay. Since the player does not directly touch the filler material filled in the container bag, there is no possibility that his body and clothes are soiled. Further, players can always play under clean conditions in the amusement system by periodically cleaning the surface of the container bag that has been touched by the players.

The plastic member may be placed on a floor in the playing space, so that the player can play on the plastic member. With this arrangement, the player can get a feeling equivalent to playing in a sandbox. The plastic member may be fixed on a partition wall of the partitioning member in the playing space or supported on a support post projecting from the floor in the playing space, so that the player can form the plastic member into various shapes.

The amusement system may further comprise vibrating means for vibrating the plastic member. With this arrangement, the plastic member is vibrated by the vibrating means to be restored into its initial uniform state with a flat surface after the player has finished playing. Therefore, the player can comfortably start playing in the amusement system.

DETAILED DESCRIPTION OF PREFERRED EMBODIMENTS

Figure 1:
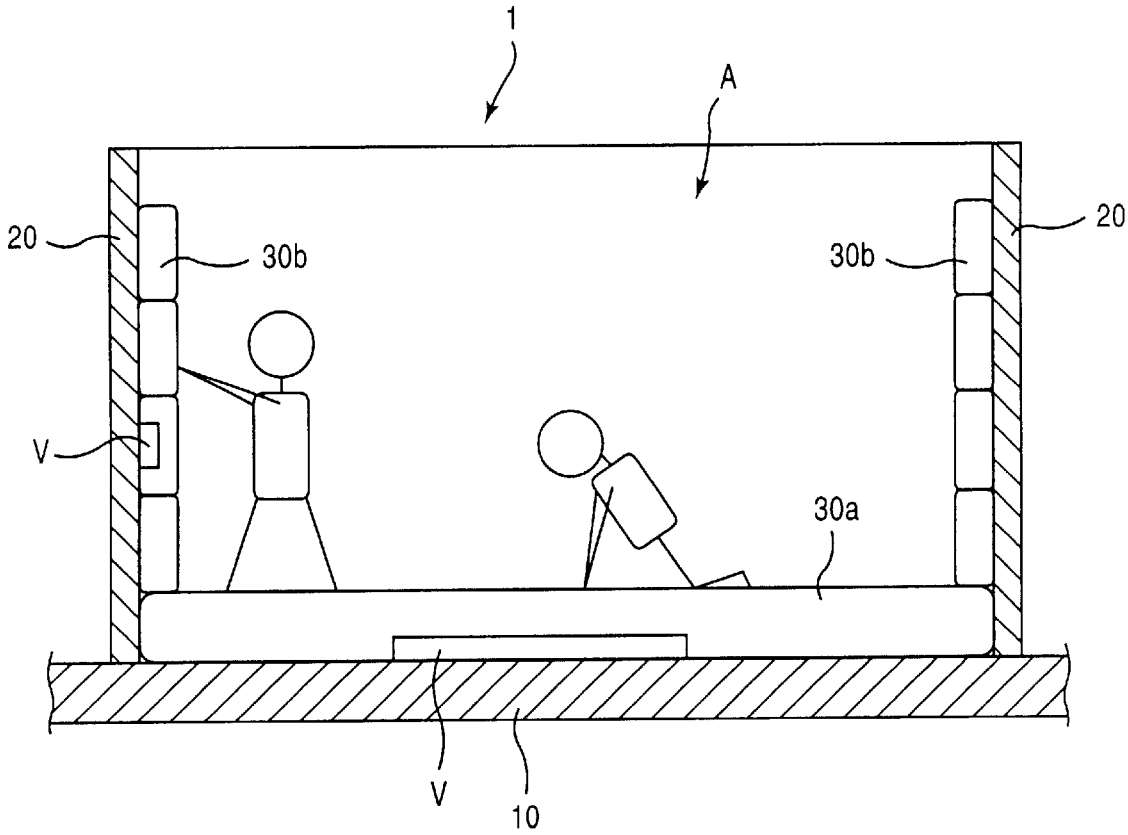
FIG. 1 is a schematic sectional view illustrating one embodiment of the present invention.

Embodiments of the present invention will hereinafter be described with reference to the attached drawings. As shown in FIG. 1, an amusement system 1 comprises a partitioning member including a floor 10 and partition plates 20 projecting upright on the floor 10. The partitioning member defines therein a playing space A. The amusement system further comprises a plastic member 30*a* provided over the floor 10 in the playing space A, and a plurality of plastic members 30*b* stacked one on another in tiers along interior surfaces (partition wall) of the partition plates 20 to a height that players can reach.

Figure 2:
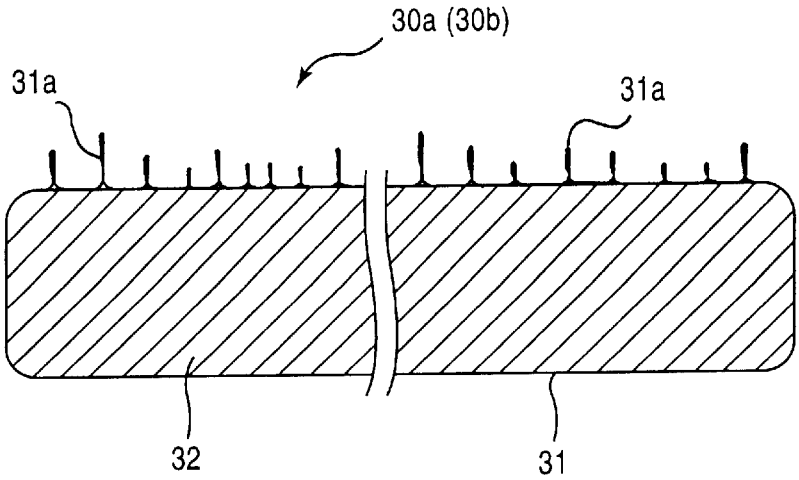
FIG. 2 is a schematic sectional view illustrating a plastic member of the amusement system.

As shown in FIG. 2, the plastic members 30*a*, 30*b* each comprise a container bag 31 of a flexible urethane sheet and a plastic material 32 as a filler material filled in the container bag 31 in a substantially air-free state. The plastic material 32 is, for example, a semisolid gel material obtained by allowing a water-absorbing polymer to absorb a predetermined volume of water. The plastic members 30*a*, 30*b* are each produced by filling the plastic material 32 into the container bag 31 to about one half the volume of the container bag 31, then removing residual air from the container bag 31 by suction and sealing the container bag 31. Slack urethane sheet portions of the container bag 31 are brought into intimate contact with each other by the removal of the air, so that the plastic members 30*a*, 30*b* each have a multiplicity of creases 31*a* on a surface thereof. Other than the gel material of the water-absorbing polymer, any of various semisolid materials such as clay and paper clay which are less fluid and easy to deform can be used as the plastic material to be filled in the container bag 31.

Figure 3:
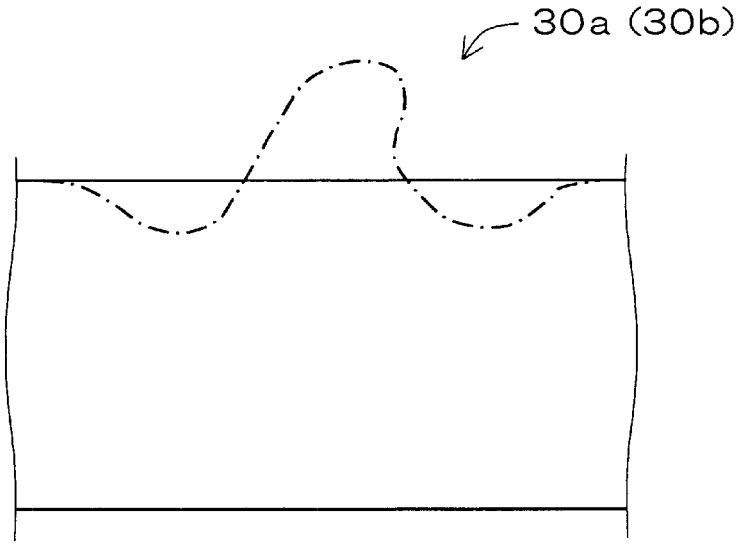
FIG. 3 is a schematic diagram illustrating deformation of the plastic member.

The player plays in the following manner in the playing space A of the amusement system 1 having the aforesaid construction. The player presses his fingers or hand against the plastic member 30*a* on the floor 10 or the plastic member 30*b* on the interior surface of the partition plate 20 to form an indentation or a hand mark thereon. Since the multiplicity of creases 31*a* are present on the surfaces of the plastic members 30*a*, 30*b*, the player can gather the plastic material 32 around one creased portion of the plastic member into a heap for formation of various shapes as indicated by a one-dot-and-dash line in FIG. 3. Thus, the player can get a feeling equivalent to playing with clay or playing with sand in a sandbox and, at the same time, he can acquire a formative artistic sense.

Since the player indirectly touches the plastic material 32 (gel material or clay) via the container bag 31 covering the plastic material 32, there is no possibility that his hands, body and clothes are soiled with the plastic material 32. Even if the player is an infant, there is no possibility that he puts a piece of the plastic material 32 into his mouth. Thus, the player can play under clean conditions in the amusement system.

Although the plastic material such as the gel material or the clay is filled in the container bags 31 to form the plastic members 30*a*, 30*b* in the aforesaid embodiment, powdery and granular materials such as sand may be used either alone or in combination instead of the plastic material 32. The volume of these particulate materials to be filled in the container bag is preferably one half the volume of the container bag 31, like in the case of the plastic material 32. In this case, the substantially air-free state is such that the particulate materials can easily be displaced in the container bag 31 by an external force and the plastic members 30*a*, 30*b* can easily be deformed by the external force.

The amusement system may further comprise a vibrator v or the like for vibrating the plastic members 30*a*, 30*b* in the playing space A. After the player has finished playing with the plastic members 30*a*, 30*b* being deformed, the plastic members 30*a*, 30*b* are vibrated by means of the vibrator, whereby the filler material 32 filled in the container bags 31 can be restored to an initial uniform state. Thus, the surfaces of the plastic members 30*a*, 30*b* are smoothed, so that the next player can comfortably start playing in the amusement system.

In the aforesaid embodiment, the plurality of plastic members 30*b* are stacked one on another in tiers along the interior surfaces of the partition plates 20. With this arrangement, the filler material filled in the container bags 31 hardly moves down due to the gravity. However, these plastic members 30*b* are not necessarily stacked in tiers.

Figure 4:
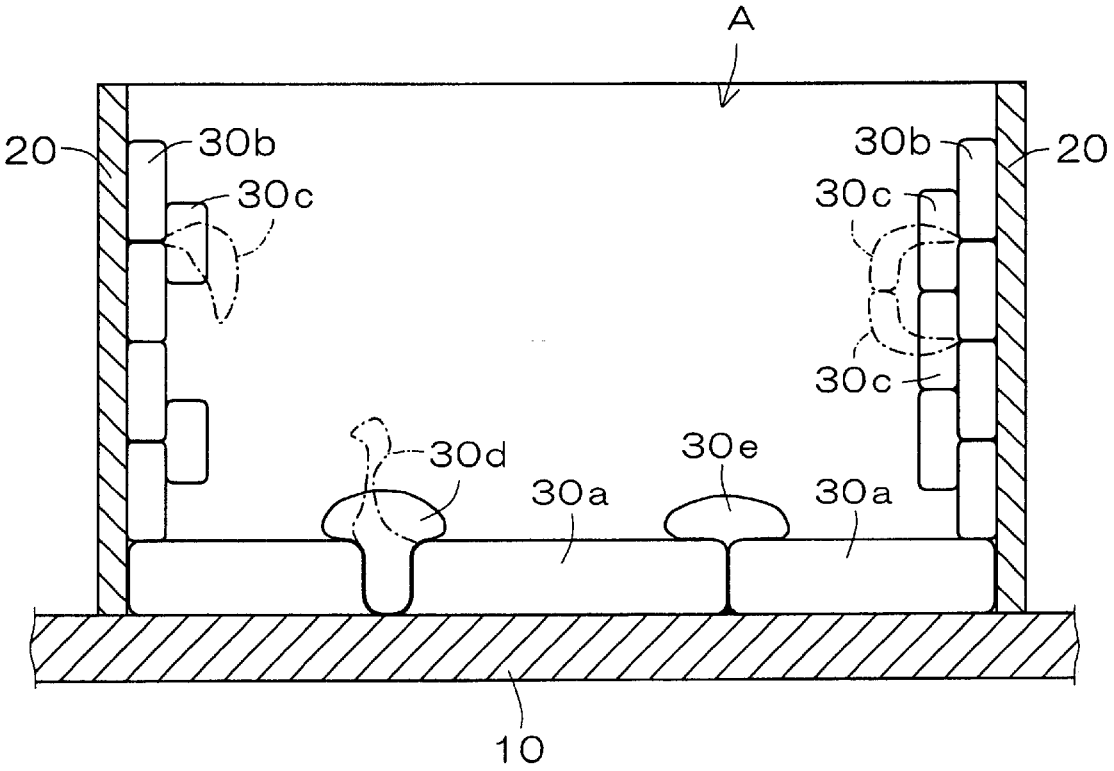
FIG. 4 is a schematic sectional view illustrating another embodiment of the present invention.

Although the plastic members 30*a* and 30*b* are simply provided as covering the surfaces of the floor 10 and the partition plates 20 in the aforesaid embodiment, additional plastic members 30*c* may be provided in association with the partition plates 20 with portions of container bags 31 of the plastic members 30*c* being held between vertically adjacent pairs of the plastic members stacked in tiers along the partition plates 20 as shown in FIG. 4. With this arrangement, the plastic members 30*c* can entirely be deformed as indicated by one-dot-and-dash lines in FIG. 4. Thus, the amusing effect can be enhanced.

Similarly, additional plastic members 30*d*, 30*e* may be provided in association with the floor 10 as shown in FIG. 4. In this case, upper and lower flexible sheet portions of the container bag 31 of the plastic member 30*a* are partially fusion-bonded to each other, and the plastic member 30*d* is attached to the fusion-bonded portion. Alternatively, a plurality of plastic members 30*a* are provided on the floor 10, and the plastic member 30*e* is provided in association with the floor 10 with a portion of the container bag 31 of the plastic member 30*e* being held between an adjacent pair of the plastic members 30*a*, like in the case of the plastic members 30*c* provided in association with the partition plates 20. With this arrangement, the plastic members 30*d*, 30*e* can entirely be deformed as indicated by a one-dot-and-dash line in FIG. 4. Thus, the amusing effect can be enhanced.

Figure 5:
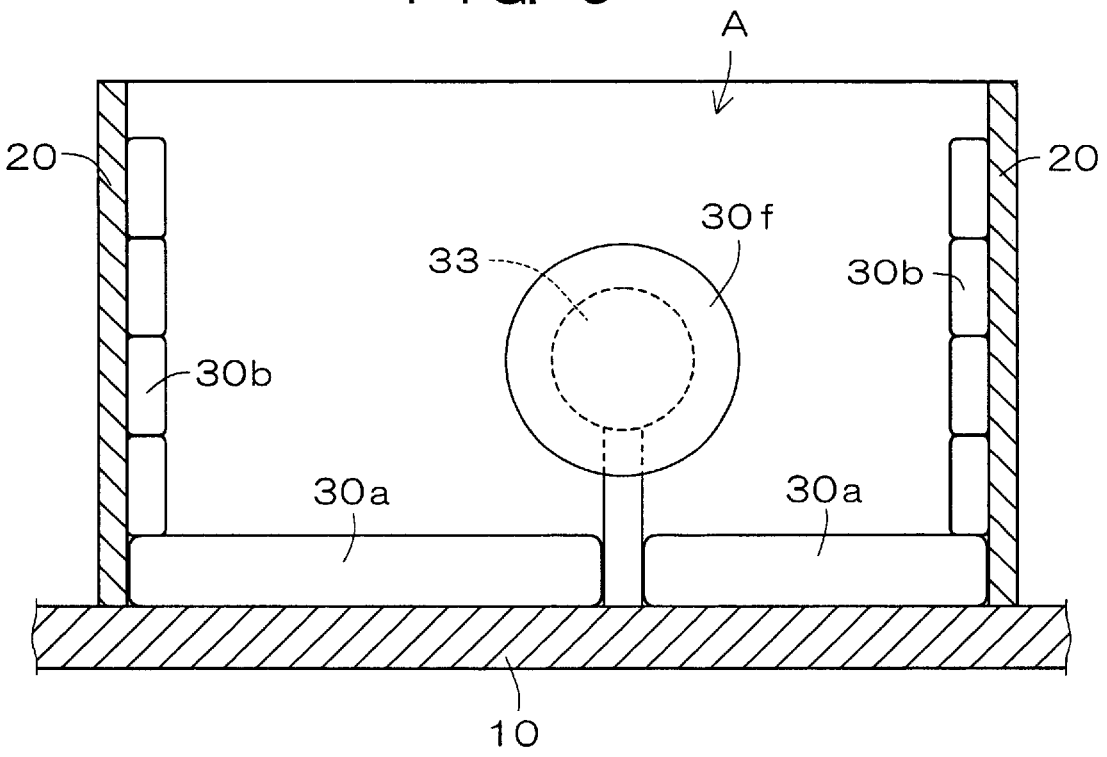
FIG. 5 is a schematic sectional view illustrating further another embodiment of the present invention.
Figure 6:
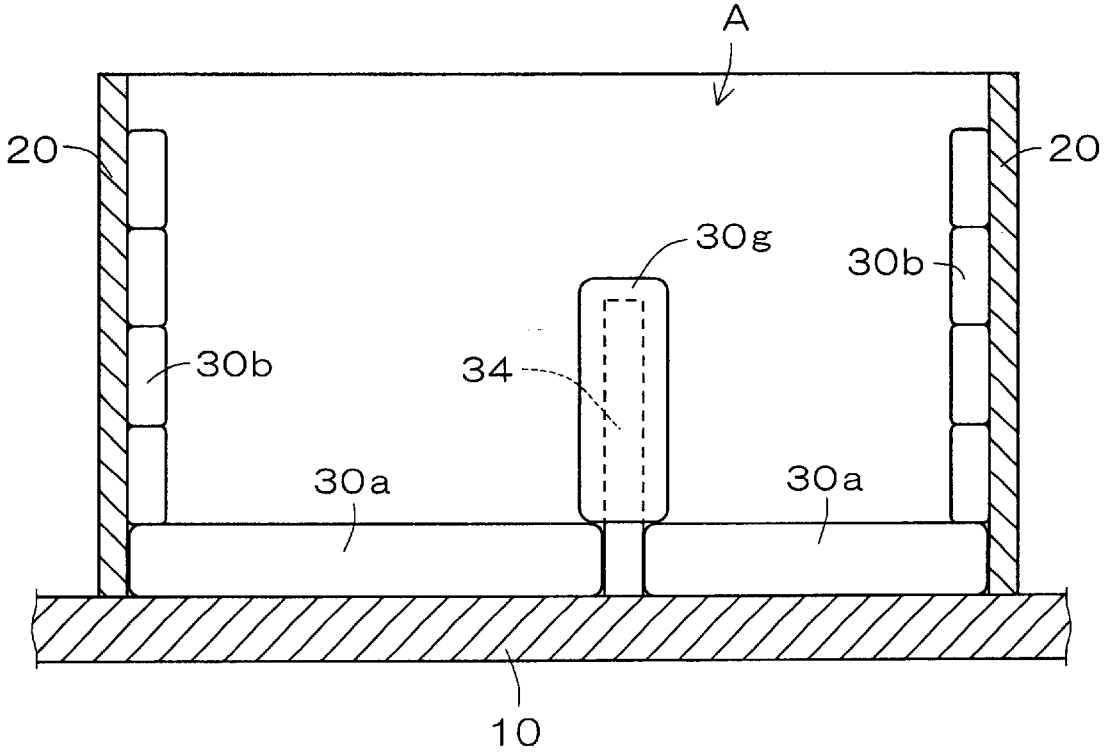
FIG. 6 is a schematic sectional view illustrating still another embodiment of the present invention.

Although the plastic members 30*a* and 30*b* are respectively provided in direct contact with the floor 10 and the partition plates 20 in the amusement system 1 shown in FIG. 1, the amusement system may be constructed such that a base is provided in a central portion of the playing space A and a plastic member is attached on the top of the base. As shown in FIG. 5, a plastic member 30*f* may be fixed around a properly sized spherical member 33 supported on the top of the base within the playing space A. Alternatively, a support post 34 may be provided as projecting from the floor 10, and a plastic member 30*g* maybe fixed to the support post 34 as covering an exposed portion of the support post 34 as shown in FIG. 6.

Further, plastic members 30*h* having various shapes such as spherical and ellipsoidal shapes may simply be placed on the plastic member 30*a* provided on the floor 10. With this arrangement, the player can deform these plastic members 30*h* while rolling and moving around the plastic members 30*h*. Thus, the amusement system provides wide variations in playing method.

Although the playing space A is defined by the floor 10 and the partition plates 20 in the aforesaid embodiments, a simple enclosure such as a fence may be employed instead of the partition plates 20 to define the playing space A. Further, one entire room may be used as the playing space, so that the plastic members are provided directly on a floor and walls thereof.

At least portions of the plastic member 30*a* on the floor 10 and the plastic members 30*b* on the partition plates 20 which will be touched by the players may be formed of a flexible sheet, and the other portions thereof which cannot directly be touched by the players may be formed of a rigid material.

Where the container bags 31 of the plastic members 30*a*, 30*b*, 30*c*, 30*d*, 30*e*, 30*f*, 30*h* are formed of variously colored flexible sheets, a visually amusing effect can additionally be provided. Further, where the container bags 31 are formed of a transparent flexible sheet and the filler material (the plastic material such as the gel material or the particulate materials) filled in the container bags 31 are variously colored, an additional amusing effect can be provided which is different from that offered in the case where the container bags are formed of the colored sheets.

Where a colored gel material pervious to light is used as the plastic material 32 to be filled in the transparent container bag 31 of the plastic member 30*a* on the floor 10, an aesthetic effect can be enhanced by lighting up the plastic member 30*a* from the under side thereof. Where a colored gel material pervious to light is used as the plastic material 32 to be filled in the transparent container bags 31 of the plastic members 30*f*, 30*g* shown in FIGS. 5 and 6 and the spherical member 33 and the support post 34 are formed of a transparent material, a similar aesthetic effect can be provided by lighting up the plastic members 30*f*, 30*g* from the inside of the spherical member 33 and the support post 34.

Figure 7:
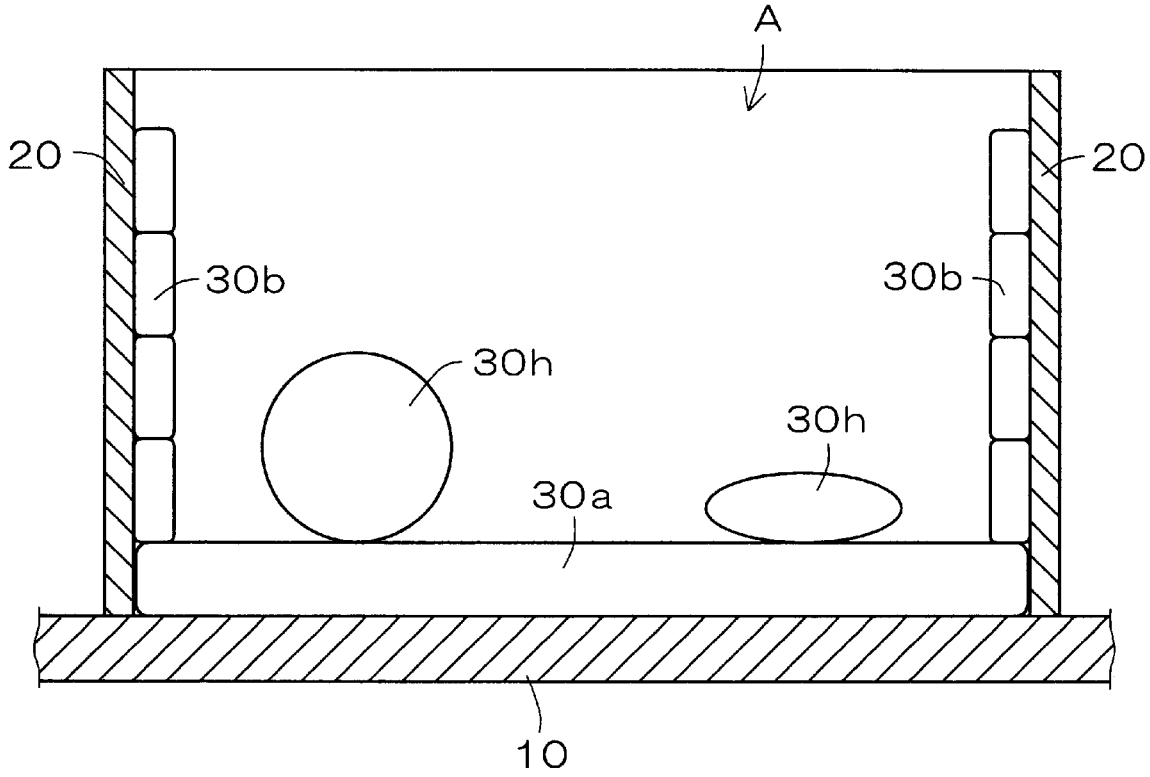
FIG. 7 is a schematic sectional view illustrating further another embodiment of the present invention.

Although the plastic members 30*a* and 30*b* are respectively provided on the floor 10 and the partition plates 20 in the aforesaid embodiments, it is not always necessary to provide both the plastic members 30*a* and 30*b*, but either of the plastic members 30*a* and 30*b* may be provided. In the amusement systems shown in FIGS. 5 to 7, the plastic members 30*a*, 30*b* may be omitted.

Where the container bags 31 are formed of a flexible and stretchable sheet, the resulting plastic members can more easily be deformed so as to be formed into a variety of shapes.

What is claimed is:

1. An amusement system comprising:

a partitioning member defining therein a playing space;

a plastic member provided in association with the partitioning member in the playing space, the plastic member comprising a container bag formed of a flexible sheet and a filler material filled in the container bag in a substantially air-free state; and vibrating means for vibrating the plastic member.

2. An amusement system comprising:

a partitioning member defining therein a playing space;

a plastic member provided in association with the partitioning member in the playing space, the plastic member comprising a container bag formed of a flexible sheet and a filler material filled in the container bag in a substantially air-free state; and vibrating means for vibrating the plastic member;

wherein the filler material is one of a plastic material and a particulate material.

3. An amusement system comprising:

a partitioning member defining therein a playing space;

a plastic member provided in association with the partitioning member in the playing space; the plastic member comprising a container bag formed of a flexible sheet and a filler material filled in the container bag in a substantially air-free state; and vibrating means for vibrating the plastic member;

wherein the partitioning member includes a floor, and the plastic member is placed on the floor within the playing space.

4. An amusement system as set forth in claim 3, wherein the plastic member includes a plurality of plastic members, which are placed on the floor as partially covering the floor.

5. An amusement system as set forth in claim 3, wherein the plastic member includes a plurality of plastic members, which are placed on the floor as entirely covering the floor.

6. An amusement system comprising:

a partitioning member defining therein a playing space; and a plastic member provided in association with the partitioning member in the playing space; the plastic member comprising a container bag formed of a flexible sheet and a filler material filled in the container bag in a substantially air-free state; and vibrating means for vibrating the plastic member;

wherein the partitioning member includes a partition wall, and the plastic member is fixed on the partition wall within the playing space.

7. An amusement system as set forth in claim 6, wherein the plastic member includes a plurality of plastic members, which are fixed on the partition wall as partially covering the partition wall.

8. An amusement system as set forth in claim 7, wherein the plurality of plastic members are located in an adjoining relation.

9. An amusement system as set forth in claim 6, wherein the plastic member includes a plurality of plastic members, which are fixed on the partition wall as entirely covering the partition wall.

10. An amusement system comprising:

a partitioning member defining therein a playing space;

a plastic member provided in association with the partitioning member in the playing space; the plastic member comprising a container bag formed of a flexible sheet and a filler material filled in the container bag in a substantially air-free state;

vibrating means for vibrating the plastic member; and a support post projecting from a floor in the playing space, wherein the plastic member is supported by the support post.

* * * * *